US005343120A

United States Patent [19]

Mulieri

[11] Patent Number: 5,343,120

[45] Date of Patent: Aug. 30, 1994

[54] DEVICE APPLICABLE TO FLUORESCENT TUBES REDUCING THE CONSUMPTION OF ENERGY WITHOUT VARIANCE OF THE LUMINOSITY

[75] Inventor: Norberto M. Mulieri, Buenos Aires, Argentina

[73] Assignee: Compania Kelmas S.A., Argentina

[21] Appl. No.: 959,067

[22] Filed: Oct. 9, 1992

[30] Foreign Application Priority Data

Oct. 9, 1991 [AR] Argentina ..... 320880

[51] Int. Cl.[5] ..... H01J 7/44

[52] U.S. Cl. ..... 315/58; 313/71; 313/DIG. 5

[58] Field of Search ..... 315/194, 291, 58, 71, 315/DIG. 5; 362/225, 296, 217, 224; 313/326, 356, 334

[56] References Cited

U.S. PATENT DOCUMENTS

| | | | |
|---|---|---|---|
| 3,996,493 | 12/1976 | Davenport et al. | 315/58 |
| 4,751,433 | 6/1988 | Baccanelli | 315/194 X |
| 4,924,365 | 5/1990 | Bogdanovs | 362/225 X |
| 5,093,767 | 3/1992 | Burn | 362/217 |

*Primary Examiner*—Robert J. Pascal
*Assistant Examiner*—Haissa Philogene
*Attorney, Agent, or Firm*—D. Peter Hochberg; Mark Kusner; Michael Jaffe

[57] ABSTRACT

A device for reducing the consumption of energy in a fluorescent tube without varying the luminosity of the tube, comprising a partially reflective curved screen having an internal diameter equal to the external diameter of the tube, and a voltage limiter connected to the terminals of the fluorescent tube.

12 Claims, 1 Drawing Sheet

DEVICE APPLICABLE TO FLUORESCENT TUBES REDUCING THE CONSUMPTION OF ENERGY WITHOUT VARIANCE OF THE LUMINOSITY

BACKGROUND OF THE INVENTION

The present invention refers to a device for gaseous discharge tubular lamps that reduces the consumption of energy by 40% without varying the luminosity of the tube to which it has been applied. In addition, the ambient contamination by ultraviolet radiation is reduced.

The term ultraviolet refers to electromagnetic radiations that have a wave length between 100 and 400 nm (nanometers).

Ultraviolet rays are invisible and are classified in three bands: long waves, called radiation UV-A from 315 to 400 nm; medium length waves, radiation UV-B from 280 to 315 nm; and short wave radiation UV-C from 100 to 280 nm.

Radiation of band UV-A passes through almost all types of glass and practically does not cause any erythema (reddening of human skin). They possess the property of promoting fluorescence in certain materials and originating photo-chemical reactions in others. The radiation of band UV-B provokes erythemal effects and tanning of the skin. These radiations are employed principally in therapeutic usage (sun lamps). Radiation of band UV-C, with maximum efficacy in the region of 254 nm wage length can lead to fluorescent phenomenon in certain materials and can cause erythema and conjunctivitis.

Bands "A" and "B" pass through almost all types of glass and the short wave band "C" is the one that energizes and produces the greatest photonic effect on phosphorus, causing the emission of luminous photons.

The point of greatest production of photons is located specifically in the wave length of 253.7 nm. This effect is found in the ionized cavity of the tubes by electronic bombardment.

This effect is not absolute, and elevated percentages of other UV wave lengths are produced. These are short, medium and long wave lengths, both above and under the optimum value of 253.7. They act harmoniously in the medium and long bands reaching even the luminous range above 400 nm. This percentage of UV, with the capability of passing through the glass of the tube (which would need a much denser cover of phosphorus to discharge its energy) is wasted and does not contribute to the photonic production. This is due to the fact that an optimum luminous effect is not obtained from the fluorescent tube.

Some designs by manufacturers of fluorescent tubes are known to augment the luminous output of said tubes by placing a reflective cover inside the tube glass. However, a significant increase in the luminosity is not obtained nor is there any additional advantage.

SUMMARY OF THE INVENTION

The purpose of this invention is to attain a major utilization of ultraviolet radiation in the fluorescent tubes in such a way as to increase the luminosity of said tubes, and to obtain a drastic reduction of energy consumption for the equivalent luminosity as listed in the respective electronic catalogues.

Therefore, the object of the present invention is a device applicable to fluorescent tubes which reduces the energy consumption without varying the light flow from said tubes, having a reflective surface for UV radiations of 100 to 400 nm, and a diffuser reflective surface for radiations of 400 to 700 nm. This is distinctive because it consists of a reflective screen in the form of an arc, and is in contact with the fluorescent tube or lamp glass at least along a line parallel to the longitudinal axis of tube or lamp glass. The internal diameter at least coincides with the external diameter of the reflective screen of the fluorescent tube glass. This is connected with a voltage depressor element fastened by connections to the terminals of the fluorescent tube.

In conventional tubes, the cover of phosphorus and glass produces a diminution of 90% in the light that passes through them; being ultraviolet rays in the long and medium bands (A and B), which on passing through the covers again, produce an excessive flow of light.

What occurs with the device according to this invention is a recycling of the ultraviolet rays within the tube by a reflective effect.

The invention will be better understood by referring to the drawings in which two forms of preferred embodiments are described and represented.

DESCRIPTION OF THE PREFERRED EMBODIMENTS

Figure 1:
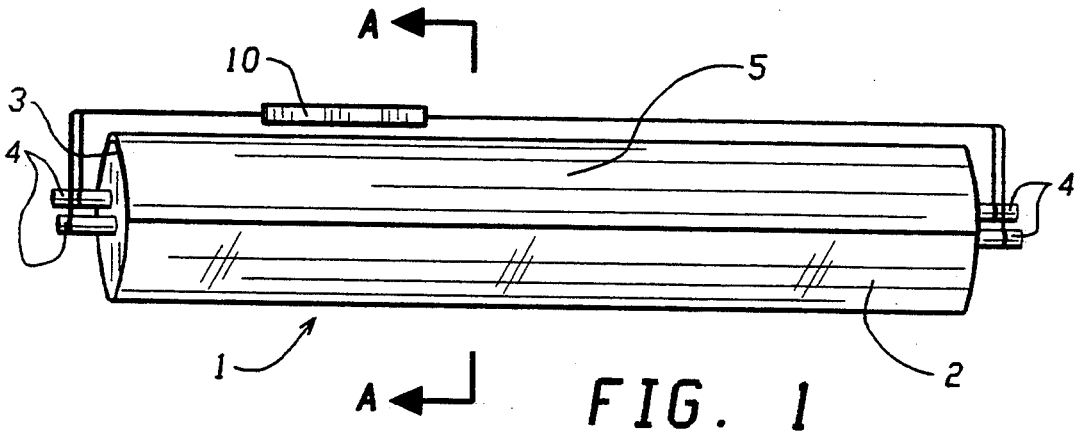
FIG. 1 represents a side view of a fluorescent tube equipped with the device according to the invention.
Figure 2:
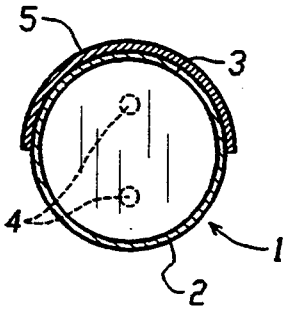
FIG. 2 represents a cross-section AA of the tube in FIG. 1.

FIGS. 1 and 2 show a fluorescent tube 1 whose upper semi-cylinder 3 is covered by a screen 5, whose reflective surface is in contact with the external surface of the glass of said semi-cylinder 3, leaving the lower semi-cylinder 2 as the surface emitting the light. Said screen 5 is preferably aluminum alone, or with aluminum plus a plaster grid and could also be of aluminum stain alone or with a grid of aluminized plastic and/or with a plastic serigraphic engraving, etc.

Said screen 5 permits the process of photonic irradiation of the phosphorus to be completely accomplished through the effect of the UV rays (medium and low) that have escaped through the fine covering of phosphates and have passed through the glass of the upper semi-cylinder 3 and are reflected within the tube 1 by the reflective surface of the screen 5.

In view of the above discussion, the light capacity of the fluorescent tube is greatly enhanced, since UV rays are guided, concentrated and reflected through the screen 5 by bombarding the phosphorus in three ways: first, outwardly through the upper semi-cylinder 3; second, inwardly by reflection of screen 5 over semi-cylinder 3; and third, outwardly through lower semi-cylinder 2. As a result of the effect of outside screen 5, the "window" or lower semi-cylinder 2, imprinted on or attached to tube 1 and in dimensional relationship (referring to the perimeter of the tube) which enables a high concentration of light in the "window" or lower semi-cylinder 2 which responds to curves of high transmission (UV-light conversion). This light concentration, with respect to the long and medium UV rays that can penetrate the glass of tube 1 and be reflected by shade 5, has been improved.

The luminosity is improved by as much as 100% over the values of the present data sheets, said improvement being obtained when the size of the screen 5 covering the tube 1 is equal to 50% of the total surface of the tube 1.

Working with the usual voltage of 220 v, the utilization of the invention causes a disproportionate increase in the temperature of the tube 1, of 55 degrees C. (which is the normal operating temperature) to 65 degrees C. or 70 degrees C. Due to this, the useful life of the fluorescent tube would be substantially shortened and would annul the desired effect. Because the production of UV would be lowered upon leaving the ideal temperature range of 25 degrees C. to 30 degrees C., it has been found necessary to add a power element limiter 10 to the screen 5 that would lower the operating voltage to 170 v. Likewise, power limiter element 10 can reduce the power by limiting the current.

Said power limiter element 10 may consist of a resistive element integrated with the screen 5. It should consist preferably of a stamped wire resistance, or of resistive material of the type of semi-conductor resins that can be heated (as in a furnace, etc.). This is glued or otherwise fixed to the exterior of the glass on top of the aluminum plate, on top of plastic or rigid bases of the alumina type, or also can be utilized with a plan capacitor that can be fastened to said screen 5 or on top of support element 7. It can also consist, among other things, of an autotransformer, or of a resistive element and a capacitor connected in series. This power limiter element 10 is connected to the terminals 4 of the fluorescent tube 1 by means of connections consisting preferably in insulated conductors (not shown).

This signifies that by means of the invention a lower voltage can be used to provide the same lumens that the fluorescent tube had before the application of the invention. For this reason, an important reduction of energy is obtained with only 170 v without any variation of the original lumens.

It has also been found that by means of the invention, the tubes can be ignited without the need of a reactance coil that is usually used for that purpose.

It has also been found that in order to obtain a correct functioning of the invention, the screen 5 must be in contact with the fluorescent tube at least along a line parallel to the longitudinal axis of the tube, since along that line interferences are originated among the UV radiations.

Measurements have been obtained which show the normal consumption of a 40 watt tube, operating at 220 v, is 420 to 440 mA on the average. The inventive device applied to the same tube for the same level of luminosity at a power supply of 170 v provides a reduction of current to about 200 mA.

This signifies that for the same level of luminosity, a reduction of energy of about 50% is obtained.

Figure 3:
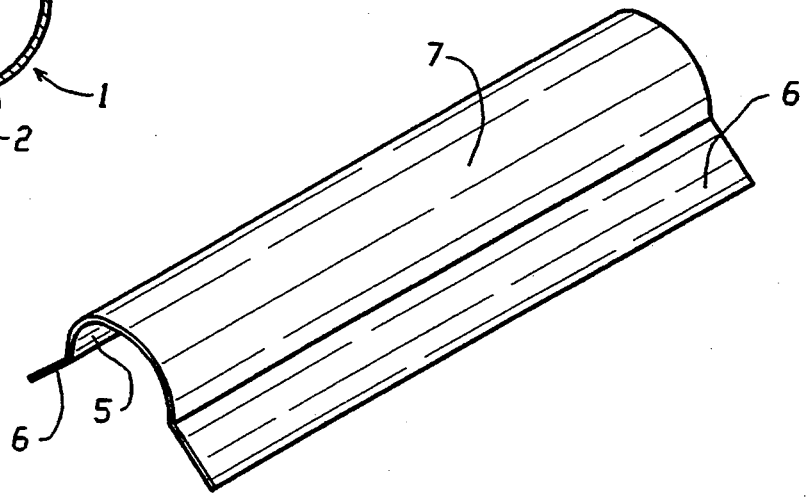
FIG. 3 represents a second embodiment of the invention.
Figure 4:
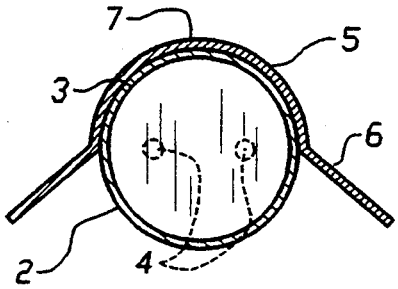
FIG. 4 represents a sectional view of the device according to the embodiment of FIG. 3, applied over a fluorescent tube.

A second preferred result of the invention is represented in FIG. 3 and FIG. 4 where the reflective screen 5 is disposed in the internal surface of support element 7, whose diameter coincides with the diameter of the tube 1. In addition, said support element 7 is equipped with fins 6, directing the light that emanates from the semi-cylinder 2.

Said screen 5 has incorporated any one of the above-mentioned voltage depressors, equipped with means of connection (not shown), and are connected to the terminals 4 of the tube.

This screen 5 can be easily applied to existing domestic installations.

An additional advantage is obtained by utilizing lower voltage, about 170 v. The fluorescent tube is operating in a temperature range of between 25 degrees C. and 30 degrees C. in an atmosphere of 23 degrees C. The fact of operating in these temperatures lengthens the useful life of the tube and is very helpful in obtaining better illumination. According to the manufacturers of the fluorescent tubes, this is an ideal temperature for the production of UV rays in the tubes.

In the case where the power limiter element 10 is not used, the obtained luminosity shall be higher than the luminosity listed for the fluorescent tube in the respective catalog.

What is claimed:

1. A device for gaseous discharge lamps, with UV radiation generation, said device comprising:

a reflective screen in the form of an arc in physical contact with said lamp, said screen having an internal diameter at least coincident with the external diameter of the lamp, said screen increasing the flow of light from said lamp over the flow of light without said screen; and a power limiter fastened to terminals of the lamp, said limiter reducing the energy to said lamp, to prevent said lamp from rising in temperature, and to extend the life of said lamp.

2. An invention device according to claim 1 wherein said lamp comprises a glass tube, and said screen is integrated to the glass tube.

3. An invention device according to claim 1 wherein said screen is removably attached to the lamp.

4. An invention device according to claim 3 wherein said screen includes fins for directing the luminous flow.

5. A device according to claim 1 wherein said screen is constructed of a material selected from treated aluminum, aluminum, a web of plastic, a web of aluminum varnish, a grid of plaster, or a grid of "aluminized" plaster.

6. A device according to claim 1 wherein said power limiter comprises a printed wire resistance.

7. A device according to claim 1 wherein said power limiter comprises printed resistive material.

8. A device according to claim 6 wherein said resistive material is a heat-resistant semi-conductor.

9. A device according to claim 1 wherein said power limiter is a capacitor with an internal timer connected to a TRIAC and a voltage coil in series.

10. A device according to claim 1 wherein said power limiter comprises a resistive element and a capacitor connected in series.

11. A device according to claim 1 wherein said power limiter is an autotransformer.

12. A device in accordance with claim 1 wherein said annular screen is substantially one-half of the exterior surface of the lamp.

* * * * *

UNITED STATES PATENT AND TRADEMARK OFFICE

CERTIFICATE OF CORRECTION

PATENT NO. : 5,343,120

DATED : August 30, 1994

INVENTOR(S) : Norberto M. Mulieri

It is certified that error appears in the above-indentified patent and that said Letters Patent is hereby corrected as shown below:

Column 2, line 6, after "diameter", insert ---of the screen---; and column 2, lines 7-8, after "diameter", delete "of the reflective screen".

Signed and Sealed this

Twentieth Day of February, 1996

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,343,120

DATED : August 30, 1994

INVENTOR(S) : Norberto Miguel Mulieri

It is certified that error appears in the above-indentified patent and that said Letters Patent is hereby corrected as shown below:

On the title page: Item[73] Assignee's replace "Argentina" with --Montevideo, Uruguay--.

Signed and Sealed this

Twenty-third Day of July, 1996

*Attest:*

BRUCE LEHMAN

*Attesting Officer*

*Commissioner of Patents and Trademarks*